US009724743B2

(12) United States Patent
Patuzzi

(10) Patent No.: US 9,724,743 B2
(45) Date of Patent: Aug. 8, 2017

(54) MOVEMENT MECHANISM WITH INDEPENDENT MOTORS FOR THE BLADE HOLDER UNIT OF PANEL BENDER MACHINE

(71) Applicant: FINN-POWER ITALIA S.R.L.

(72) Inventor: Luigi Patuzzi, Cologna (IT)

(73) Assignee: FINN-POWER ITALIA S.R.L., Cologna (IT)

( * ) Notice: Subject to any disclaimer, the term of this patent is extended or adjusted under 35 U.S.C. 154(b) by 530 days.

(21) Appl. No.: 14/366,646

(22) PCT Filed: Dec. 14, 2012

(86) PCT No.: PCT/EP2012/075616
§ 371 (c)(1),
(2) Date: Jun. 18, 2014

(87) PCT Pub. No.: WO2013/092436
PCT Pub. Date: Jun. 27, 2013

(65) Prior Publication Data

US 2014/0338418 A1 Nov. 20, 2014

(30) Foreign Application Priority Data

Dec. 22, 2011 (IT) ..... VR2011A0232

(51) Int. Cl.
*B21D 5/04* (2006.01)
*B21D 5/00* (2006.01)

(52) U.S. Cl.
CPC ..... *B21D 5/04* (2013.01); *B21D 5/006* (2013.01); *B21D 5/045* (2013.01)

(58) Field of Classification Search
CPC ..... B21D 5/006; B21D 5/045; B21D 5/04
(Continued)

(56) References Cited

U.S. PATENT DOCUMENTS 4,411,148 A * 10/1983 Aschauer ..... B21D 5/045 72/306
4,843,862 A * 7/1989 Salvagnini ..... B21D 5/045 72/319

(Continued)

FOREIGN PATENT DOCUMENTS

EP 1609543 A1 12/2005
EP 1819457 A1 8/2007

(Continued)

OTHER PUBLICATIONS

International Search Authority, Search Report for International Application PCT/EP2012/0755616, Feb. 21, 2013 (EPO), 2 pages, The Hague, Netherlands.

*Primary Examiner* — David B Jones
(74) *Attorney, Agent, or Firm* — Ference & Associates LLC

(57) ABSTRACT

A bender machine designed to bend and shape sheet metal comprising a blade holder unit (1) which has a "C" shaped section, which is mobile and moves in two directions, both of which are at right angles to a fixed bench, and where the unit is fitted with one or more bending blades, wherein:

servomotors and planetary gear reducers are used for moving the blade holder unit (1);

the blade holder unit (1) uses a jointed mechanism comprising two mechanical units (20, 20*a*; 30, 30*a*) which form a closed kinematic chain of five components connected by five kinematic pairs all of which are revolute;

the mechanical unit (20, 20*a*) for moving the blade holder unit (1) in a substantially vertical direction comprises a pair of servomotors coupled respectively to two gear reducers, which operate respective cranks (9, 9*a*) on which respective connecting rods (8, 8*a*) are hinged, and where the other end of each connecting rod is (Continued)

connected by respective pins (7, 7*a*) to a respective base (10, 10*a*) fixed to the blade holder unit (1).

The mechanical unit (30, 30*a*) for moving the blade holder unit (1) in a substantially horizontal direction comprises one pair of servomotors (6, 6*a*) coupled to corresponding planetary gear reducers, each of which operates a respective camshaft (3, 3*a*), and also characterized in that the camshafts (3, 3*a*) are hinged on the rear supports (2, 2*a*) of the blade holder unit (1).

5 Claims, 3 Drawing Sheets

(58) Field of Classification Search
USPC ..... 72/306, 319, 450
See application file for complete search history.

(56) References Cited

U.S. PATENT DOCUMENTS

| | | | | |
|---|---|---|---|---|
| 7,114,360 | B2 * | 10/2006 | Ikeda | B21D 5/045 72/306 |
| 8,006,531 | B2 * | 8/2011 | Patuzzi | B21D 5/045 72/306 |
| 8,312,752 | B2 * | 11/2012 | Patuzzi | B21D 5/045 72/306 |
| 9,314,829 | B2 * | 4/2016 | Kunze | B21D 5/045 |
| 2007/0266752 | A1 * | 11/2007 | Patuzzi | B21D 5/006 72/16.1 |

FOREIGN PATENT DOCUMENTS

| | | | |
|---|---|---|---|
| EP | 2127771 | A1 | 12/2009 |
| WO | 2006043292 | A1 | 8/2007 |
| WO | 2008029421 | A1 | 3/2008 |

* cited by examiner

MOVEMENT MECHANISM WITH INDEPENDENT MOTORS FOR THE BLADE HOLDER UNIT OF PANEL BENDER MACHINE

TECHNICAL FIELD

This invention relates to a movement mechanism for the blade holder unit of a panel bender for bending sheet metal sheets.

In particular the present invention relates to a mechanism where the blade holder unit is moved by four servomotor reducer units operating independently from each other.

The invention is mainly applied in the field of panel benders for making profiles starting from metal sheets.

BACKGROUND ART

Prior art panel benders are known which operate the process for bending a sheet of sheet metal using a pair of blades mounted on a blade holder unit which is a substantially "C" shaped structure and which may be hydraulically or electro-mechanically operated.

In this type of machine, a sheet metal sheet to be bent is clamped by a device, known as a presser or sheet presser, which moves in a direction at right angles to the plane of the metal sheet itself and is compressed against a fixed part, known as the counterblade.

Each of the two blades, upper and lower, describes a curvilinear trajectory in the two degrees of horizontal (X) and vertical (Y) freedom, in directions respectively parallel to and at right angles to the plane of the metal sheet.

During this movement the blade enters into contact with the metal sheet and bends it into various shapes. The trajectory may be fixed or in some cases is programmed on computer numeric control (CNC) systems which interpolate the two axes X and Y.

The European patent EP-B1-1819457 represents the state of the art which is closest to the present invention. Its blade holder unit has a kinematic chain which has an architecture substantially comprising a jointed pentalateral assembly whose actuating components are cranks driven by an electric motor coupled to a high-precision reduction gear suitable for high torques.

In this case the blade holder unit uses a jointed mechanism formed by two mechanical units designed to control respectively the horizontal movement and the vertical movement of the blade holder unit.

More specifically, the first mechanical unit, which controls the horizontal movement of the blade holder unit, comprises an independent servomotor fitted with a crank which is in turn connected to a connecting rod. The other end of the connecting rod hinges on the end of a lever fitted with a pivot positioned on the shaft. The other end of this lever, the end opposite the one attached to the connecting rod, is connected to a set of pins located on the ends of a pair of supports which in turn have an expanding shape linked with the blade holder.

The second mechanical unit, which controls the vertical movement of the blade holder unit, comprises two servomotors which actuate cranks which in turn are hinged on respective connecting rods. The other ends of the connecting rods are attached to the base of the "C" shaped blade holder unit.

It should be noted that all the cranks described in this patent can also be eccentric elements with the same function.

The reader can refer to the patent EP-B1-1819457 for further constructional details. It should be noted that the geometry of the mechanism described in the patent EP-B1-1819457 has the work space necessary for the correct moving of the bending blades in the fields of application of the invention. It also has the special geometrical configurations, (for the single kinematic conditions where there is kinematic inversion of motion) around the configurations where the mechanism bends the sheet of metal, needed to generate the necessary amplification of the drive torques.

The machine according to the patent EP-B1-1819457 has several major advantages in comparison with the panel bender machines of the prior art. In particular, this machine provides a new bending trajectory which allows the bending blade to roll on the metal sheet without scraping it. This trajectory is particularly useful when processing material with a protective film because it prevents breakage of the film and damage to the metal sheet.

An additional advantage is that the servomotors and reduction gear used make it possible to achieve performance levels which are certainly much higher than those obtained using the prior art hydraulic systems. The servomotors and reduction gear also guarantee the delivery of a constant torque throughout the bending cycle. This cannot be obtained with hydraulic systems which use accumulators and which therefore operate at a pressure which slowly decreases during bending. This enables consumption to be optimised and reduced to levels which are 60% lower than those of traditional machines.

A further advantage is that the semi-finished material processed with the machine made according to patent EP-B1-1819457 is of excellent quality and obtained with a machine which is considerably more stable and repeatable in comparison with traditional machines. This is because it is not sensitive to the thermal variations which occur on machines with hydraulic systems. It is also quieter than prior art machines and uses a much reduced amount of oil because it has a very simple hydraulic circuit.

The environmental impact of this machine is also completely different from that of prior art machines. It is more reliable, consumes less, is quieter and uses much less oil.

The machine described in patent EP-B1-1819457 has all the advantages described above in relation to prior art machines. However, actual use of this machine has highlighted some shortcomings and problems which do not appear to be easy to overcome. On the machine described in document EP-B1-1819457 the horizontal movement is generated by a single servomotor reducer. This feature means that the machine cannot perform off-centre bendings. In other words, with this machine it is not possible to position the metal sheet at any point in the work zone.

An additional disadvantage is that it is not possible to obtain variable bends on workpieces such as ferrules because this machine does not enable different trajectories.

Lastly, the configuration of the machine described in patent EP-B1-1819457 cannot be changed freely as required. This makes it sensitive to variations in thermal and mechanical conditions and consequently creates not inconsiderable problems in maintaining the mechanical tolerances specified.

DESCRIPTION OF THE INVENTION

This invention overcomes the typical drawbacks and disadvantages of the prior art by providing a movement mechanism which allows the sheet to be positioned at any point of the work zone and by providing a variety of different trajectories which enable the production of variable bends such as those on ferrules.

This is achieved by means of a movement mechanism for the blade holder of a panel bender having the characteristics described in claim 1.

The dependent claims describe particularly advantageous embodiments of the mechanism according to this invention.

According to the present invention, the "C" shaped blade holder unit is moved in an approximately horizontal direction by a pair of rear expansions coupled to two independent eccentric pins each of which is moved by its own servomotor and reducer. In addition, each eccentric pin is designed to both drive the tilting movement of the unit and to act as a crankshaft providing the bending force required.

In the present invention, the "C" shaped blade holder unit is moved in an approximately vertical direction by a pair of servomotors and reducers which are connected to and drive cranks and connecting rods and where the other ends of the cranks and connecting rods are connected to the base of the "C" shaped blade holder unit.

The blade holder unit comprised in this way is equipped with four mechanical units which form a closed kinematic chain which drives all the movements of the blade holder structure which in turn is supported by four revolute pairs comprising angle bearings.

DESCRIPTION OF THE DRAWINGS

The invention is described below with reference to the attached drawings, provided as a non-binding example, in which.

DESCRIPTION OF ONE EMBODIMENT OF THE INVENTION

Figure 1:
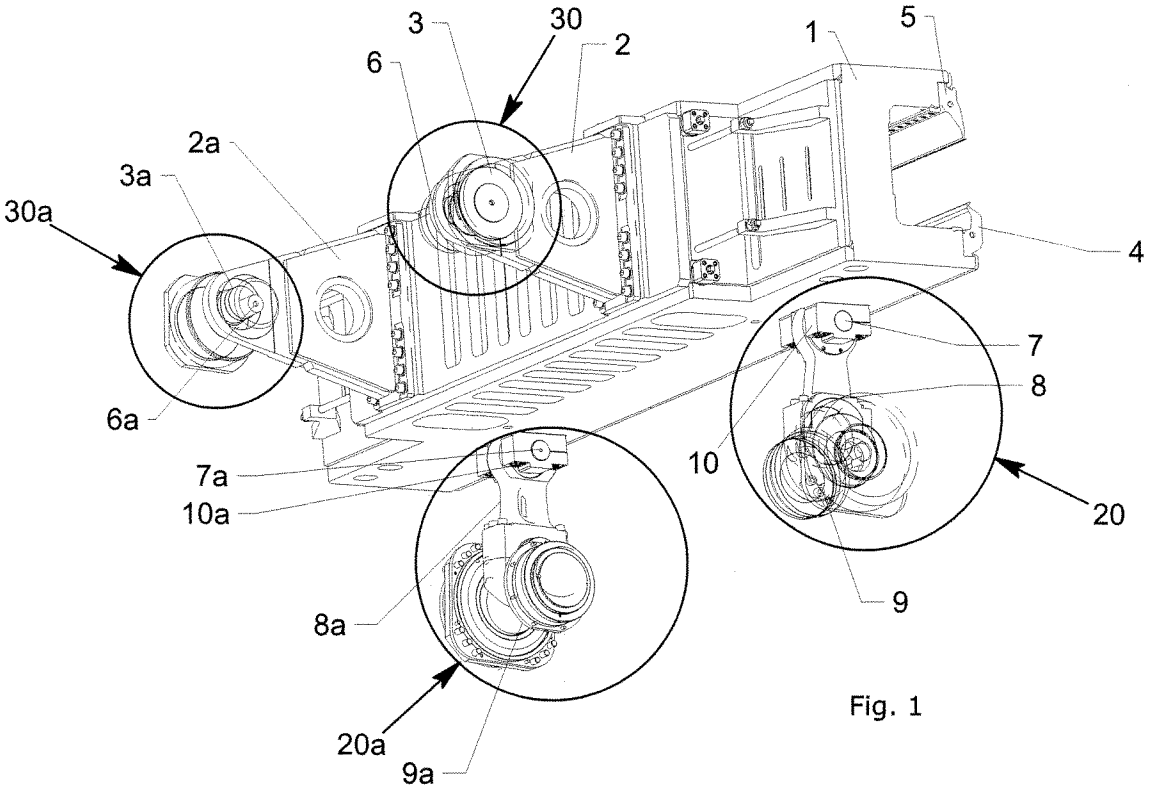
FIG. 1 shows a rear perspective view of the "C" shaped blade holder unit of a panel bender according to the present invention.

FIG. 1 shows a panel bender for bending sheet metal sheets comprising a "C" shaped blade holder 1 to which a pair of blades comprising a lower blade 4 and an upper blade 5 are fixed. The blade holder unit 1 is moved by servomotors and planetary gear reducers as described in greater detail below.

The rear part of the blade holder unit structure comprises a fixed pair of supports or expansions 2, 2*a* while the lower part is fitted with bases 10, 10*a*. The supports 2, 2*a* and the bases 10, 10*a* are actuated by a special kinematic system whose chain has two effective degrees of freedom and forming two mechanical units one of which 30, 30*a* is designed to move the blade holder unit 1 in an approximately horizontal direction and where the other 20, 20*a* is designed to move the blade holder unit 1 in an approximately vertical direction.

The jointed system comprising the entire mechanism is kinematically considered to be a flat mechanism where the term flat mechanism is understood as describing a mechanism whose components move on a flat plane with the axes of the revolute pairs parallel to each other and at right angles to the flat plane of motion.

The topology of the system, the number of its components and the type of coupling makes this a closed kinematic chain of five components connected by five kinematic pairs all of which are revolute.

One of the components is the machine frame. This kinematic chain has two effective degrees of freedom which enable the use of two independent servomotors each installed on its respective mechanical unit.

According to the present invention, the first mechanical unit comprises one pair of respective servomotors 6, 6*a* coupled to corresponding planetary gear reducers, each of which operates a camshaft 3, 3*a* on which the supports 2, 2*a* of the blade holder unit 1 are hinged.

The camshafts 3, 3*a* have two different functions. They act as rotation pins for the tilting movement of the blade holder unit 1 and at the same time also act as a crankshaft which generates the approximately horizontal movement of the blade holder unit 1.

The second mechanical unit 20, 20*a* comprises a pair of servomotors coupled respectively to two gear reducers which operate respective cranks 9, 9*a* on which connecting rods 8, 8*a* are hinged, and where the other end of each connecting rod is connected by respective pins 7, 7*a* to a base 10, 10*a* of the blade holder unit 1.

The geometry of the mechanism:

- has the work space necessary for efficiently moving the bending blades in the field of application envisaged;
- has the special geometrical configurations, (for the single kinematic conditions where there is kinematic inversion of motion) around the configurations where the mechanism bends the sheet of metal, needed to generate the necessary amplification of the drive torques. There are two configurations, one for the 'positive bend' and one for the 'negative bend'.

Figure 2:
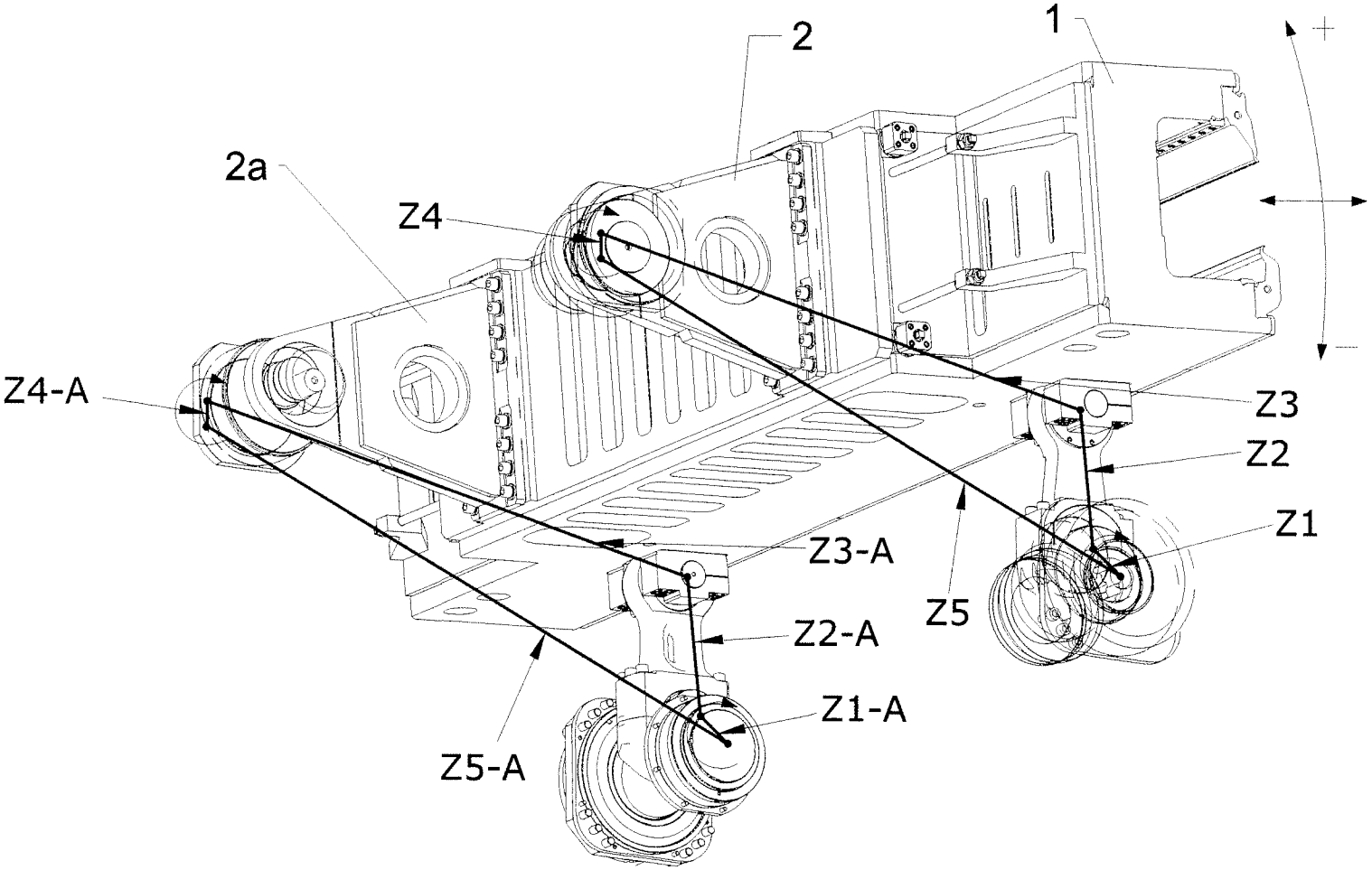
FIG. 2 shows the same rear perspective view of the blade holder unit as in FIG. 1, but also showing the movements performed by the various components.
Figure 3:
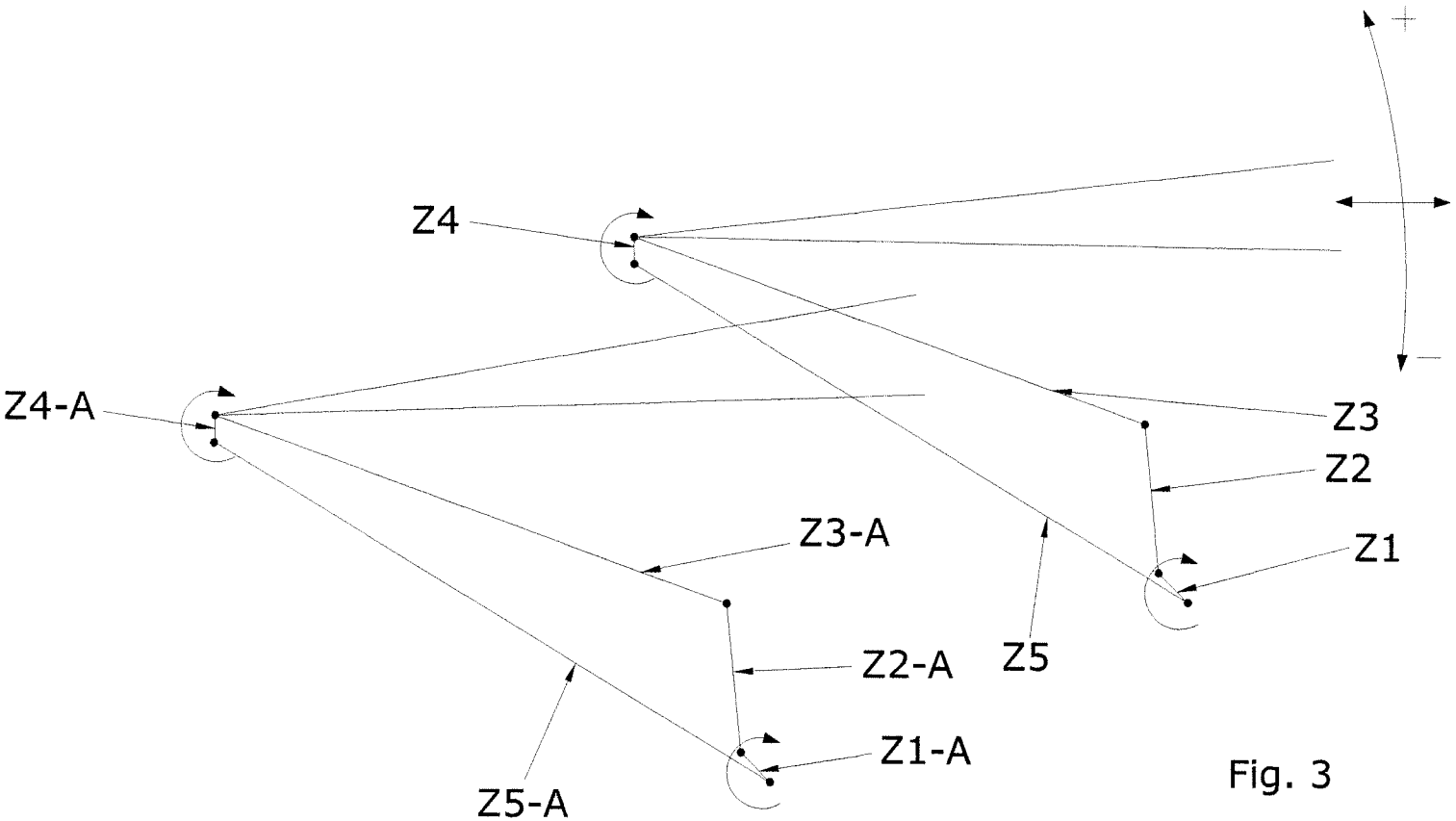
FIG. 3 is a vector diagram showing the movements performed by the blade holder unit with the kinematic architecture shown in FIG. 1.

FIGS. 2 and 3 show the link trajectories where the Z references indicate the following kinematic connections:

Z1—crank 9 of the first link between the motor and the connecting rod 8;

Z1*a*—crank 9*a* of the second link between the motor and the connecting rod 8*a;*

Z2—trajectory of the connecting rod 8 of the first link;

Z2*a*—trajectory of the connecting rod 8*a* of the second link;

Z3—trajectory of the first link between the hinge of the connecting rod 8 and the blade holder unit 1, and hinge 6 of the camshaft 3;

Z3*a*—trajectory of the second link between the hinge of the connecting rod 8*a* and the blade holder unit 1, and hinge 6*a* of the camshaft 3*a;*

Z4—movement of the camshaft 3 of the first link between the motor and the rear expansion 2 of the blade holder unit 1;

Z4*a*—movement of the camshaft 3*a* of the first link between the motor and the rear expansion 2*a* of the blade holder unit 1.

In particular the trajectories and movements described above permit all movements of the blade holder unit 1 in the substantially horizontal and approximately vertical directions and in the positive and negative directions with respect to the base plane. This is shown in the top right-hand portion of the FIGS. 2 and 3.

The present invention has considerable advantages when compared to the kinematic structure and configuration of the machine made according to European patent No. 1819457. These advantages are as follows.

In practice, the presence of two independent servomotors to move the blade holder unit 1 in the horizontal direction makes it possible to position the metal sheet to be bent at any point in the work zone. This is not possible on the system made according to the European patent cited above where the metal sheet must be positioned perfectly in the centre of the work zone.

The presence of two mechanisms with independent control means that it is possible to vary the torque delivered by each motor to match the force required. In some cases it is even possible to create a counter torque to obtain the right balance of forces required.

A further advantage with respect to European patent No. 1819457 is that the mechanism according to the present invention enables different trajectories to be implemented on the two horizontal and vertical work units. This makes it possible to obtain variable bends on parts during production and in particular to obtain parts with variable geometry such as ferrules.

The mechanism according to the present invention makes it possible to vary the overall configuration of the panel bender so as to compensate for any variations due to thermal or mechanical influences.

The invention described above refers to a preferred embodiment.

Nonetheless, it is clear that the invention is susceptible to numerous variations which lie within the scope of its disclosure as defined in the attached claims.

The invention claimed is:

1. A kinematic system for actuating a work unit of a bender machine designed to bend and shape sheet metal, wherein the bender machine comprises a blade holder unit having a "C" shaped section, wherein the blade holder unit is mobile and moves in two directions, wherein one of the two directions comprises a substantially horizontal direction with respect to a fixed bench and wherein another of the two directions comprises a substantially vertical direction with respect to the fixed bench, and wherein the blade holder unit comprises one or more bending blades, wherein the kinematic system comprises:

a first mechanical unit wherein the first mechanical unit moves the blade holder unit in the substantially vertical direction with respect to the fixed bench;

the first mechanical unit comprising a first pair of servomotors coupled to a corresponding pair of gear reducers, wherein each of the servomotors in conjunction with the corresponding gear reducers are coupled to and operate respective cranks, wherein a connecting rod is hinged to each of the cranks, and wherein the other end of each connecting rod is connected to a base fixed to the blade holder unit by respective pins; and a second mechanical unit, wherein the second mechanical unit moves the blade holder unit in the substantially horizontal direction with respect to the fixed bench;

the second mechanical unit comprising a second pair of servomotors coupled to a corresponding pair of planetary gear reducers, wherein each of the servomotors in conjunction with the corresponding planetary gear reducers are coupled to and operate respective camshafts, and wherein the rear supports of the blade holder unit are hinged on the respective camshafts and wherein the respective camshafts act as rotation pins for a tilting movement of the blade holder unit and as a crankshaft which generates the substantially horizontal movement of the blade holder unit.

2. The kinematic system according to claim 1, wherein the substantially vertical direction movement and the substantially horizontal direction movement implemented respectively by the first and second mechanical units are independent and different from each other.

3. A bender machine designed to bend and shape sheet metal, comprising a blade holder unit having a "C" shaped section, wherein the blade holder unit which is mobile and moves in two directions, wherein one of the two directions comprises a substantially horizontal direction with respect to a fixed bench and wherein another of the two directions comprises a substantially vertical direction with respect to the fixed bench, and wherein the blade holder unit comprises one or more bending blades.

4. The bending machine according to claim 3, wherein the movement of the blade holder unit is driven by servomotors and planetary gear reducers, and wherein the blade holder unit uses a jointed mechanism comprising two mechanical units which form a closed kinematic chain of five components connected by five kinematic pairs all of which are revolute.

5. The bending machine according to claim 4, wherein the two mechanical units implement trajectories which are independent and different from each other.

* * * * *